United States Patent [19]

Contreras, Sr.

[11] 4,454,889

[45] Jun. 19, 1984

[54] COMPACT WITH AIR TIGHT CLOSURE

[76] Inventor: Joseph P. Contreras, Sr., Brockden Dr., Mendam, N.J. 07945

[21] Appl. No.: 534,161

[22] Filed: Sep. 21, 1983

[51] Int. Cl.[3] ..... A45D 33/00

[52] U.S. Cl. ..... 132/82 R; 132/83 R; 220/256

[58] Field of Search ..... 132/83 R, 82 R, 82 H, 132/82 F, 83 E, 83 D, 83 H, 79 F, 79 G, 82 C; 229/6, 5, 7; 206/824, 215; 220/240, 340, 356, 362, DIG. 26, 14, 256; 222/184, 215, 498

[56] References Cited

U.S. PATENT DOCUMENTS 2,035,830 3/1936 Parkin ..... 220/256

3,160,327 12/1964 Porcelli ..... 220/256

3,424,340 1/1969 Rocher ..... 220/356

4,345,607 8/1982 Contreras ..... 132/83 R

*Primary Examiner*—Gregory E. McNeill

*Attorney, Agent, or Firm*—Daniel H. Bobis

[57] ABSTRACT

A compact or container having an air or fluid tight seal for holding, storing or packaging ultra-moist powders, pulverulent material and water based cosmetics, and paste type materials such as creams and emulsions includes, a resilient generally flat leaf type member so fixed and cantilevered in assembled position on the base portion of the compact or container that the raised peripherial edge thereon can coact with the inner face of the closure member to form the desired air or fluid tight seal thereon.

12 Claims, 9 Drawing Figures

COMPACT WITH AIR TIGHT CLOSURE

BACKGROUND OF THE INVENTION

This invention relates generally to compacts and containers and more particularly to compacts and containers adapted for holding, storing or packaging ultra-moist powders and pulverulent materials such as water based cosmetics, powders and semi-solid or paste type material such as creams and emulsions.

Compacts and containers having air tight closures are known in the prior art such as is shown in U.S. Pat. Nos. 2,054,004; 2,488,850; 2,763,271; 2,631,722 and 2,190,990.

The present invention provides an improved compact with an air or fluid tight closure in which a resilient generally flat leaf type member is so fixed and cantilevered in assembled position on the base portion of the compact that the peripheral edge can coact with the inner face of the closure member to form the desired air or fluid tight seal for the compact.

This construction does not in any measurable fashion affect the normal mechanical action of a compact in accordance with the present invention.

Further, however the construction is adaptable for retrofitting existing compacts with minimal adjustment of existing tooling or investment in additional tooling.

SUMMARY OF THE INVENTION

Thus, the present invention covers an improved compact comprising, a base assembly defining a compartment for moist pulverulent material, a resilient member connected about the compartment in said base assembly, and disposed to extend radially outward therefrom, a generally continuously raised peripheral edge on the resilient member, a closure member pivotally connected to the base assembly movable from open to closed position and vice versa, said closure member having an inner seal face disposed on closing movement of the closure member to form a fluid tight seal with said raised peripheral edge of the resilient member.

Accordingly, it is an object of the present invention to provide a compact or container with an air tight closure.

It is another object of the present invention to provide an improved compact or container with an air tight closure which substantially eliminates the escape of moisture therefrom and at the same time provides easy and convenient access to the moisturized product in the compact or container.

It is another object of the present invention to provide a compact or container having elements operatively associated with the closure means for establishing an air tight seal on closing movement of the closure means for the compact or container.

It is still another object of the present invention to provide a compact or container with an air tight closure sufficient to retain the moisture in an ultra-moist product contained therein in which the normal mechanical action of opening and closing the compact or container is not affected to any measurable degree.

These and other objects of the present invention will become apparent from the following description taken in conjunction with the accompanying drawings showing a preferred embodiment of the invention in which:

DESCRIPTION OF A PREFERRED EMBODIMENT

Figure 1:
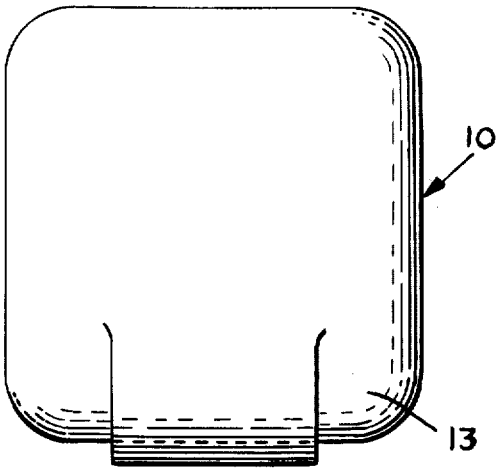
FIG. 1 is a top plan view of a compact with an air tight closure in accordance with the present invention.
Figure 2:
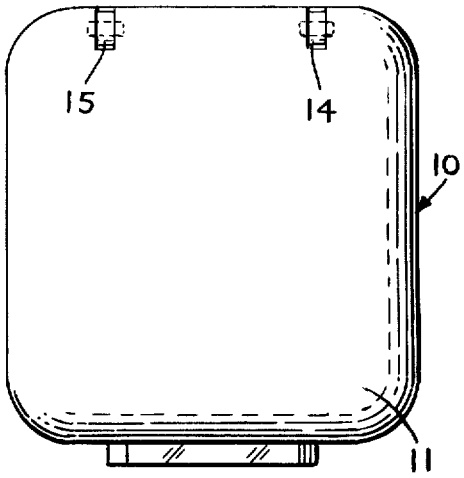
FIG. 2 is a bottom view of the compact shown in FIG. 1.
Figure 3:
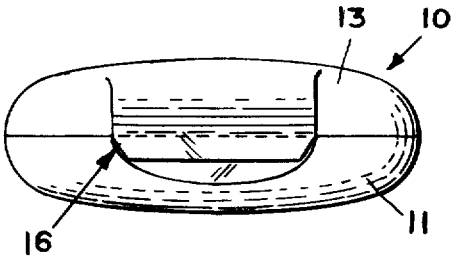
FIG. 3 is front view of the compact shown in FIG. 1.
Figure 4:
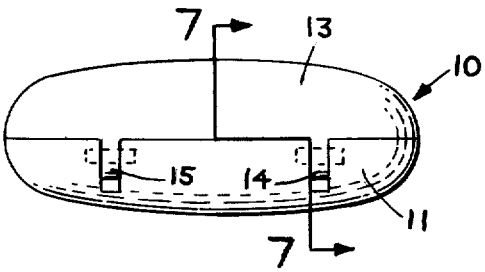
FIG. 4 is a back view of the compact shown in FIG. 1.
Figure 5:
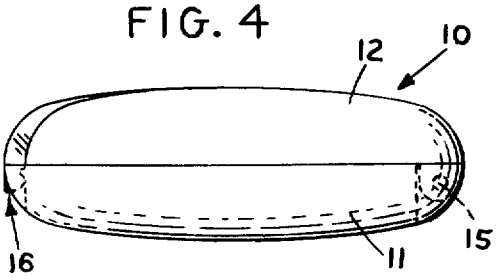
FIG. 5 is a right side view of the compact shown in FIG. 1.

Referring to the drawings FIGS. 1 to 8 show one preferred form of the invention as a compact generally designated 10.

Compact 10 includes, a base assembly having, a base member 11 and an inset or compartment member 12. A closure member or cover 13 is pivotally connected as by spaced hinge members 14 and 15 to the back end of the base member 11 so that it can be rotated relative the base assembly from the closed positions as shown in FIGS. 1 to 5 and 6 of the drawings to the open position as shown by the phantomized lines at FIG. 6 of the drawing.

Figure 7:
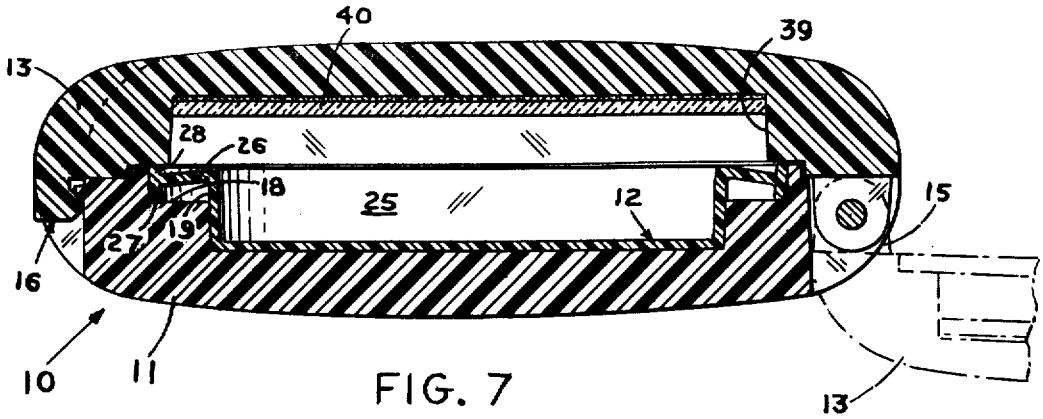
FIG. 7 is a vertical section taken on line 7—7 of FIG. 3 showing the compact in the closed position in solid lines and a fragment of the closure member or cover rotated to open position by the phantomized lines.
Figure 8:
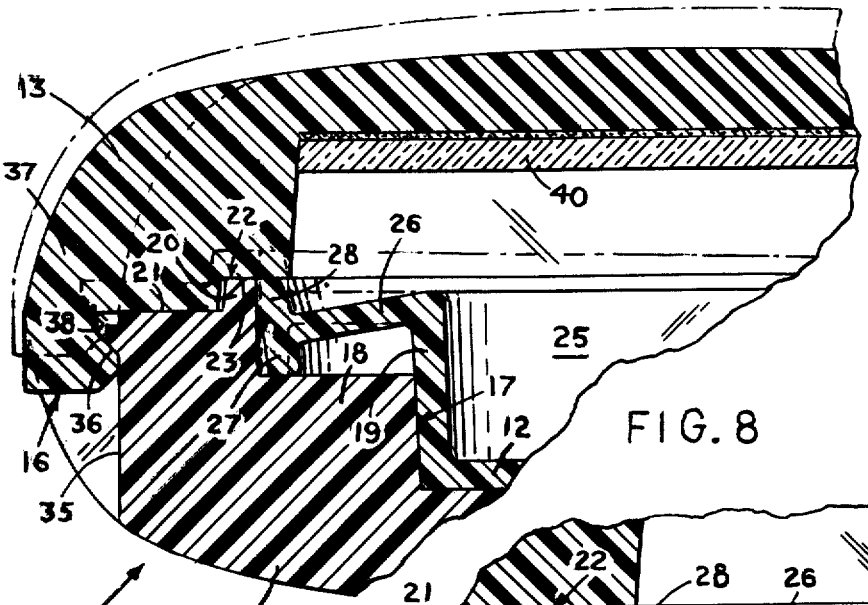
FIG. 8 is an enlarged fragmentary view showing the front or latch section of the compact shown in FIG. 6 showing the peripheral edge of the leaf spring section of the insert portion of the base assembly moved from the open position shown in dotted lines to the closed position shown in the solid lines.

The closure member or cover 13 is held in the closed position in engagement with the base member 11 by a suitable latch assembly generally designated 16, as shown in FIGS. 7 and 8 and more fully described hereinafter.

The base member 11 and the closure member or cover 13 are preferably molded from plastic materials such as acrylonitrile-butadiene-styrene (ABS) and polycarbonate (SAN) having the strength and appearance to provide a compact adapted for the commercial marketplace and for pivotally connecting the closure member or cover 13 to the base member 11.

Further while the compact illustrated is square in plan view, it will be understood by those skilled in the art that the shape and size of the particular container which utilizes the improved air tight seal and closure in accordance with the present invention, will be in accordance with the desired commercial requirements for the particular unit.

Inset or compartment member 12 will also be made of a plastic material such as polypropylene resin or any other material to provide the required chemically inert properties and the characteristics of resiliency required to provide the advantageous sealing effect with the closure member without interfering with the normal opening and closing movement of the compact or container.

Figure 6:
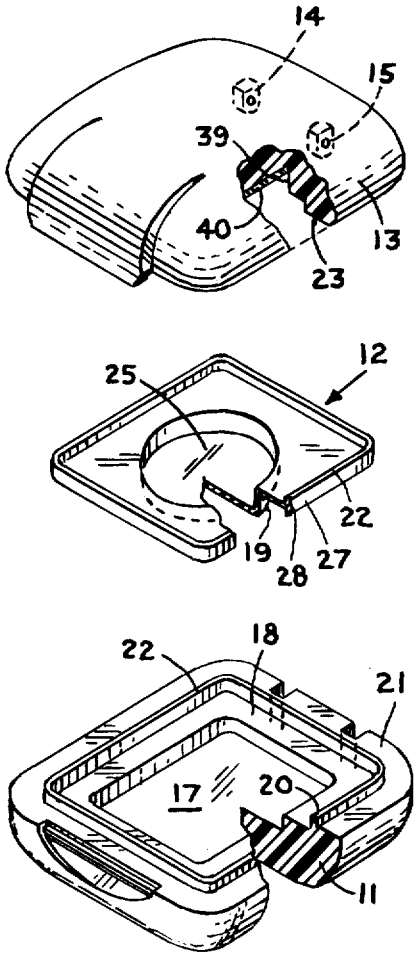
FIG. 6 is an exploded perspective view of the compact shown in FIG. 1 showing the base assembly, the associated insert unit, and the closure member or cover each partly broken away in vertical section.

The base member 11 in the illustrated form of the compact 10 has a sized central space or cavity 17 defined by a generally circular shoulder 18 which projects radially inward from the wall of the base member. The cavity 17 and the shoulder 18 will be shaped, tapered and sized so that a mating section 19 on the lower face of the insert member 12 can be friction fitted or adhesively connected or snapped into fixed engagement in the space or cavity 17 in the base member 11 to form the base assembly for the compact 10, all of which is shown in FIGS. 6, 7 and 8 of the drawings.

Circumferentially formed on the base member 11 about the portion thereof defined by the shoulder 18 an upstanding annular bead or tongue 20 projects a predetermined fixed distance above the flat annular, upper or top surface 21 of the base member 11. The upper surface or face of the upstanding bead 20 forms a stop shoulder 22 which engages the lower or bottom sealing face 23 of the closure member or cover 13 when the closure member 13 is moved to the closed position during the use of the compact 10.

Inset member 12 is shown as an integral generally flat relatively thin element which is square in plan view and shaped so that it fits and matches the shape defined by the cavity 17 and generally circular shoulder 18. Inset member 12 is molded so that a compartment 25 is formed in the upper face thereof for receiving and storing the ultra-moisturized pulverulent or other moisture laden composition of material therein. The lower or obverse face thereon forms the mating section 19 which adapts the inset member 12 to be fitted into tight engagement with the central space 17 and generally circular shoulder 18 formed in the base member 11.

Molded inset section 12 also provides an annular leaf spring section 26 which extends radially outward from the compartment 25. Remote from the compartment or inner end of the leaf spring section 26 the peripheral edge thereof has a flange as at 27 generally transverse or preferably perpendicular to the generally horizontal plane of the leaf spring section 26 of the inset member 12. Flange 27 is so disposed that the flange extends both above and below the horizontal plan of the leaf spring section 26 all of which is clearly shown in FIGS. 6, 7 and 8 of the drawings.

The annular leaf spring section 26 is molded from polyethylene or polypropylene resin with a thickness in a range from 0.017" to 0.025" and preferably 0.021" so that when a force of only about 0.5 PSIG is exerted on the upper section or end 28 of the flange 27 it will deflect sufficiently to form the desired seal on movement of the closure member 13 to the closed position without interfering or compounding or increasing the normal forces of between 1 to 5 PSIG required to move the closure member 13 to open position which forces are similar to those exerted on conventional compacts which do not have an air or fluid tight closure of the type herein disclosed as will now be more fully described.

Figure 9:
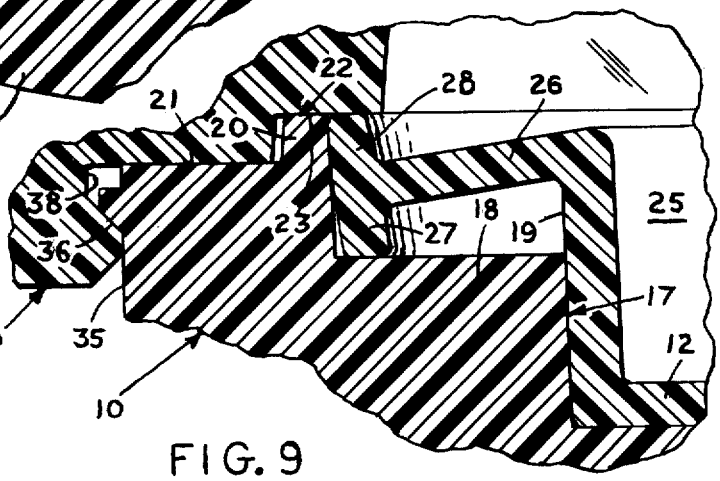
FIG. 9 is an enlarged fragmentary view of the air tight seal assembly shown in FIG. 8.

Thus, FIGS. 6, 7 and 8 show that in assembled position, the inset section has the leaf spring section cantilevered over the generally circular shoulder 18 so that the flange 27 is adjacent to the annular bead or tongue 20 formed on the base member 11. When the compact 10 is in the opened position, the upper section or end 28 of flange 27 will extend above the stop shoulder 22 on the annular bead or tongue 20 as is shown by the phantomized lines in FIGS. 8 and 9 of the drawings. By further reference to FIGS. 6, 7, 8 and 9 of the drawings the pivotally connected closure member 13 is shown as having an inner face 30 which is counterbored to form the sealing face 31 which is shaped and sized sufficiently wide to coact with the upper section 28 of the flange member 27 and the stop shoulder 22 formed on the annular bead 20.

Thus, as shown in FIGS. 7 and 8, when the cover member 13 is rotated from the open position as shown by the phantomized lines in FIG. 7 to the closed position shown by the solid lines in FIGS. 7 and 8, the seal face 23 will first engage the upper section 28 of the flange 27 adjacent the back or hinge end of the inset member and then progressively will deform the back and side sections and finally the front section thereof adjacent the latch assembly 16.

Since the leaf spring section is deformable it will during the closing movement of the closure member 13 deform from the generally horizontal cantilevered position as shown in FIG. 8 of the drawings and at the same time the flange 27 will be slightly compressed until the closure member comes into contact with the annular bead 20 formed on the base member 11. This deformation is approximately 0.020"

The amount of compression on the leaf spring sections 26 and flange 27 necessary in order to insure that the seal will be air or fluid tight is relatively low because the inset section and more particularly the leaf spring section is so sized and proportioned that the compression will not exert extensive force against the sealing face 23. Those skilled in the art will readily recognize that if the forces exerted are unnecessarily high then when the closure member 13 is released from the latched position as shown in FIGS. 7 and 8 it will tend to spring up and possibly dislodge the contents of the pulverulent or other materials in the compartment 25.

This deformation of the annular leaf spring section 26 will not be permanent. Thus, when the cover or closure 13 is rotated to open position the leaf spring section will return to the generally horizontal position as shown by the phantomized lines in FIG. 8 of the drawings.

In order to maintain the air or fluid tight seal the closure member 13 must be held in the closed position. For this purpose a latch is provided at the front end of the compact 10. This is accomplished in the present form of the invention by undercutting the base member as at 35 in the front section thereof, leaving a small lip or strike as at 36, and providing on the closure member an overlapping latch element 37 which has an undercut groove 38 therein matched and mated to the projecting lip or tongue 38 for holding the closure member 13 in the latched position when the sealing face 22 of the closure member 13 is brought into contact with the stop shoulder 22 on the annular bead 20 of the base member.

This construction also permits a recess 39 to be formed in the wall of the closure member 13 on the inner face thereof in which a mirror 40 can be mounted for use when the compact 13 is moved from closed to the open position. This is a desirable feature on compacts because mirrors are not often readily available when the user of the compact needs to utilize the cosmetics or other materials that may be held and stored in the compartment 25 of the compact.

OPERATION

In operation, when the compact 10 is to be filled the closure member 13 is moved to open position by inserting a fingertip under the latch section 27 of the closure member 13 and exerting force against this section to release the latch 37 from the strike 36 on the base member 11.

The compartment is filled with the ultra-moist pulverulent or other moisture laden composition of material. Then, the closure member 13 is moved from the open position at which time the seal face 23 is brought into progressive engagement with the upper end 28 of the flange 27 to form the air or fluid tight seal therewith and then the closure member is finally moved to the latched position to maintain the entire air or fluid tight seal so formed by the closure member during such closing action.

The factors which have bearing on the force to be exerted on the cantilevered annular leaf spring 26 are, the coefficient of elasticity of the polypropylene resin or like material from which the inset member 12 is made, and the degree of deformation of the leaf spring section as the closure member is moved to the closed position. The moment of force which must be overcome to establish the air tight closure for the compact 10 will be a function of the width of the leaf spring section plus the force required to compress the flange until the seal face of the closure member engages the stop shoulder 22 of the annular bead 20 on the base member.

Thus an improved compact or container is provided which allows an ultra moist product to be packed, held and stored therein which will provide an effective air or fluid tight seal allowing the product to retain its moisture and wherein the assembly requires minimal pressure on the closure member to maintain the seal and therefor does not affect the movement of the closure member from closed to open position.

It will be understood that the invention is not to be limited to the specific construction or arrangement of parts shown but that they may be widely modified within the invention defined by the claims.

What is claimed is:

1. A compact having an air tight closure comprising, a. base assembly means defining a compartment for moisture laden material, b. closure means operatively connected to said base assembly and movable from open to closed position and vice versa relative the same, c. said base assembly means including, a leaf spring means fixedly connected about the compartment and having a cantilevered section extending radially outward, d. said closure member having, a seal face formed on the lower surface thereof, e. said seal face operative on closing movement of the closure member to engage the peripheral end of the cantilevered section to deform the cantilevered section whereby an air tight seal is formed when the closure member moves to the closed position, and f. latch means for holding the closure member in engagement with the base assembly operable to release the closure member on opening movement thereof.

2. A compact having an air tight closure comprising, a. a base assembly defining a compartment therein, b. a closure member pivotally connected to said base assembly and movable from open to closed position and vice versa relative the same, c. said base assembly including, a generally annular leaf spring means having the central portion thereof fixedly connected in said base assembly about the compartment, d. said leaf spring member having a cantilevered section disposed to extend radially outward from the fixedly connected central section to provide a free peripheral end remote therefrom, e. flange means formed on the free peripheral end section of the leaf spring means, f. said closure member having, a seal face disposed on closing movement to engage the flange means to deform the cantilevered section of said leaf spring whereby an air tight seal is formed between the closure member and the base assembly in the closed position, and g. latch means for holding said closure member and base assembly in the closed position operable to release the closure member for movement to open position.

3. In the compact as claimed in claim 2 wherein, a. said base assembly has an upper face, and an annular head formed on the upper face defining, a stop shoulder, b. said seal face on the closure member disposed on closing movement to engage the stop shoulder to limit closing movement of the closure member and the deflection of the said annular leaf spring member.

4. In the compact as claimed in claim 2 wherein the annular leaf spring means is made of a plastic material and has a thickness in a range from 0.017" to 0.025".

5. In the compact as claimed in claim 2 wherein the annular leaf spring means is made of polypropylene resin material and has a thickness of 0.021".

6. In the compact as claimed in claim 2 wherein the annular leaf spring means is deflected from the generally horizontal position on closing movement of the closure member approximately 0.020".

7. In the compact as claimed in claim 2 wherein;

a. the annular leaf spring means is made of a plastic material and has a thickness in a range from 0.017" to 0.025", b. said base assembly has an upper face, and an annular stop means formed on said upper face, and c. said seal face on the closure member disposed on closing movement to engage said annular stop means to limit closing movement of the closure member and the deflection of the said annular leaf spring member.

8. A compact having an air tight closure comprising, a. base assembly means, including a base member, and an inset section, b. closure means connected to said assembly means movable from open to closed position and vice versa, c. said inset section defining a compartment in the central section thereof and a leaf spring member extending radially outward from the central section of the inset member to form a cantilevered section with a free peripheral end remote from the compartment, d. flange means about the peripheral end of the cantilevered section of said leaf spring member, and e. said closure member having an inner seal face disposed to engage the flange means on movement to closed position to stress the cantilevered section whereby an air tight closure is formed, and f. latch means for holding said closure member in closed position operable to release the closure means for movement to open position.

9. In the compact as claimed in claim 8 wherein, a. said base member has an upper face, and an annular stop means formed on the upper face, b. said inner seal face on the closure member disposed on closing movement to engage the annular stop means to limit closing movement of the closure member and deflection of the cantilevered section of the leaf spring member.

10. In the compact as claimed in claim 8 wherein the cantilevered section of the leaf spring member is made of plastic and has a thickness in a range from 0.017" to 0.025".

11. In the compact as claimed in claim 8 wherein the inset section is made of polypropylene resin material and the cantilevered section of the leaf spring member has a thickness of 0.021".

12. In the compact as claimed in claim 8 wherein the cantilevered section of the leaf spring member is deflected from the generally horizontal position on closing movement of the closure member approximately 0.020".

* * * * *